US005535918A

United States Patent [19]

Hathaway et al.

[11] Patent Number: 5,535,918

[45] Date of Patent: Jul. 16, 1996

[54] SPARGING ADAPTER

[75] Inventors: John E. Hathaway; Harold D. Pawlowski, both of Fort Wayne, Ind.

[73] Assignee: Tuthill Corporation, Fort Wayne, Ind.

[21] Appl. No.: 323,864

[22] Filed: Oct. 17, 1994

[51] Int. Cl.[6] ..... B67B 7/00

[52] U.S. Cl. ..... 222/1; 222/318; 417/431; 366/101

[58] Field of Search ..... 222/318, 333, 222/383, 376, 1; 417/431; 366/101, 106; 239/143

[56] References Cited

U.S. PATENT DOCUMENTS

| | | | |
|---|---|---|---|
| 3,016,200 | 1/1962 | Boehm | 229/143 X |
| 3,166,020 | 1/1965 | Cook | 239/143 X |
| 3,385,480 | 5/1968 | Tidwell | 366/101 X |
| 5,219,274 | 6/1993 | Pawlowski et al. | 417/213 |

*Primary Examiner*—Gregory L. Huson
*Attorney, Agent, or Firm*—Roger M. Rickert

[57] ABSTRACT

A liquid dispensing vessel having an air space above the liquid near the top of the vessel has a fluid pump with a suction inlet and a pressure outlet. The pump is operable in a first mode to pump liquid and in a second mode to pump air. There is a first conduit coupling the suction inlet and liquid near the bottom of the vessel, a second conduit coupling the suction inlet and the air space above the liquid near the top of the vessel, a third conduit coupling the pressure outlet to a dispensing device, and a fourth conduit coupling the pressure outlet to liquid near the bottom of the vessel. A valving arrangement is effective to block both the second and fourth conduits for operating the pump in the first mode, and to open the second and fourth conduits for operating the pump in the second mode. The valving arrangement is preferably formed by valves in the second and fourth conduits and an arrangement which is common to the two valves for contemporaneous opening and closing both valves.

8 Claims, 5 Drawing Sheets

SPARGING ADAPTER

SUMMARY OF THE INVENTION

The present invention relates generally to pumps and more particularly to pumps which handle agricultural chemicals or other relatively viscous liquids. In particular, the present invention relates to such a pump and an adapter or fitting which allows the pump to alternately provide a sparging feature.

The concept of "sparging" to mix materials which do not mix well or have a tendency to settle or separate is well known. Such systems typically utilize filtered compressed air or a dedicated air compressor and release the air at the bottom of a tank containing a suspension. That air then rises through and agitates the liquid, helping to mix and keep the materials in suspension. Such systems are relatively large, e.g. the size of a transport truck. Sparging is not applied to small, e.g., 50 to 200 gallon containers.

The concept of recirculating the liquid within a container for mixing purposes is also old. Liquid from the bottom is pumped out and returned to the top. The Lucore 5,050,995 U.S. patent teaches recirculating liquid such as agricultural seeding and other fluids, and expelling that liquid above the liquid level in the tank through jets to maintain the mix. Holt, U.S. Pat. No. 4,106,699 and Bede U.S. Pat. No. 2,727,786 recirculate paint to keep it mixed. Lucore U.S. Pat. No. 4,723,710 and Beaston U.S. Pat. No. 4,856,683 relate to recirculating agricultural materials.

U.S. Pat. No. 5,219,274 discloses a double acting pump for moving relatively viscous liquids such as agricultural chemicals having a rotary drive mechanism for powering the pump along with a pair of opposed pumping chambers for alternately supplying the liquid under pressure from a pair of chamber inlets to a corresponding pair of chamber outlets. A shuttle block is reciprocable along a path for actuating the pumping chambers and includes a cam and follower arrangement for converting rotational motion of the drive mechanism into reciprocating motion of the shuttle block. The pumping chambers include a pair of movable members such as diaphragms which move in unison in one direction to decrease the volume of one of the pumping chambers while increasing the volume of the other of the pumping chambers, and move in the opposite direction to decrease the volume of the other of the pumping chambers while increasing the volume of the one pumping chamber. There is a resiliently yieldable arrangement coupling the shuttle block to the pair of movable members for limiting the pressure within the pumping chambers to predetermined maximum pressures without utilizing a pressure relief bypass. The resiliently yieldable arrangement may comprise a spring-loaded lost motion coupling and it functions to absorb energy while limiting the pressure in a chamber and releases that stored energy to help power the pump while expelling fluid from the other chamber.

The presently preferred embodiment of the present invention is in the form of an adapter which allows the lastmentioned patented pump to be converted from its liquid pumping function to an air pump for sparging (mixing) purposes. Most liquid pumps do not work effectively with air, but the applicant has discovered this one does.

Due to stratification and differences in viscosity in the stratified layers, mixing by the conventional technique of pumping fluid from the bottom of the vessel back onto the top may be ineffective or inefficient. With one commercial agricultural chemical at 40 degrees F., mixing was still inadequate after 45 minutes of conventional liquid recirculation. Acceptable homogeneity was, however, obtained by the sparging technique of the present invention after only 10 minutes.

Among the several objects of the present invention may be noted the provision of a combined liquid dispensing pump and liquid sparging device utilizing a common pumping device; the provision of a technique for dispensing uniformly mixed liquid and particulate matter; the provision of a fluid pump having a suction inlet and a pressure outlet which is operable in a first mode to pump liquid for dispensing purposes and in a second mode to pump air for sparging purposes; and the provision of a liquid sparging system where the air used for sparging is obtained from within the liquid container. These as well as other objects and advantageous features of the present invention will be in part apparent and in part pointed out hereinafter.

In general, a method of dispensing liquid requiring mixing therein from a liquid containing vessel includes the utilization of a pumping device to repeatedly pump air to a location near the bottom of the vessel beneath the liquid level to agitate and mix the liquid and any particulate matter that may be present. That same pumping device is utilized to pump liquid from a location near the bottom of the vessel beneath the liquid level for dispensing and utilization of the liquid at a time when air is not being pumped from the air space. Preferably, the vessel has an air space above the liquid near the top of the vessel and the air which is repeatedly pumped to the location near the bottom of the vessel is obtained from the air space above the liquid thereby forming a closed relatively contamination free system.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
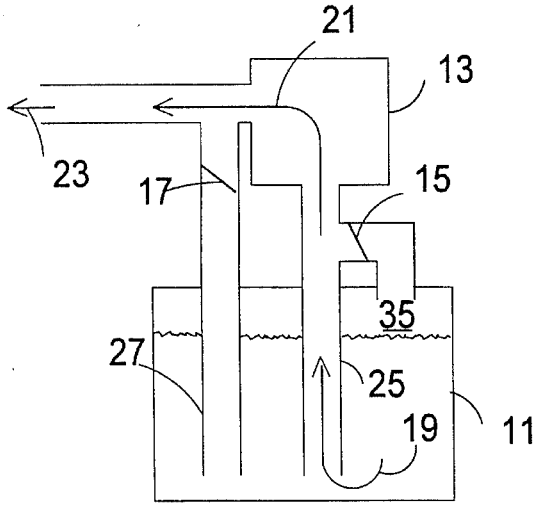
FIG. 1 is a simplified cross-sectional view of a pump, adapter and liquid containing vessel according to the present invention in the liquid pumping mode.
Figure 2:
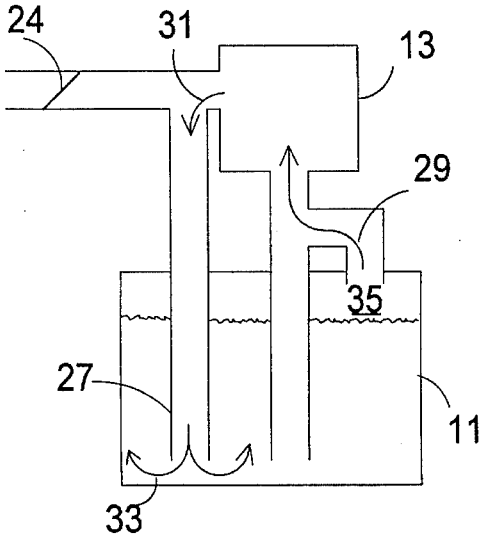
FIG. 2 is a simplified cross-sectional view similar to FIG. 1, but illustrating the sparging mode.
Figure 3A:
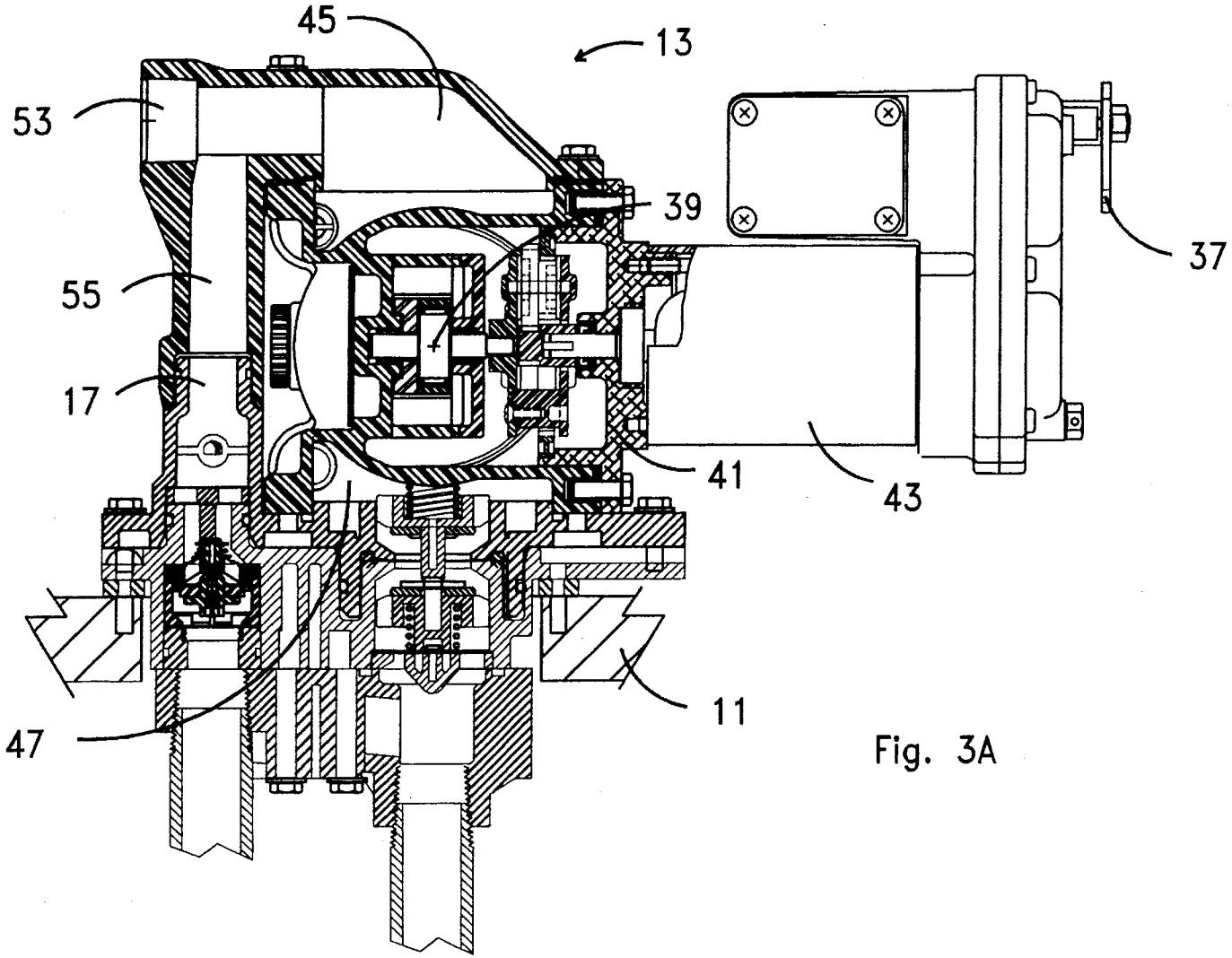
FIG. 3A is a detailed cross-sectional view of the sparging adapter along the lines 1—1 shown in the plan view of FIG. 3D.
Figure 3B:
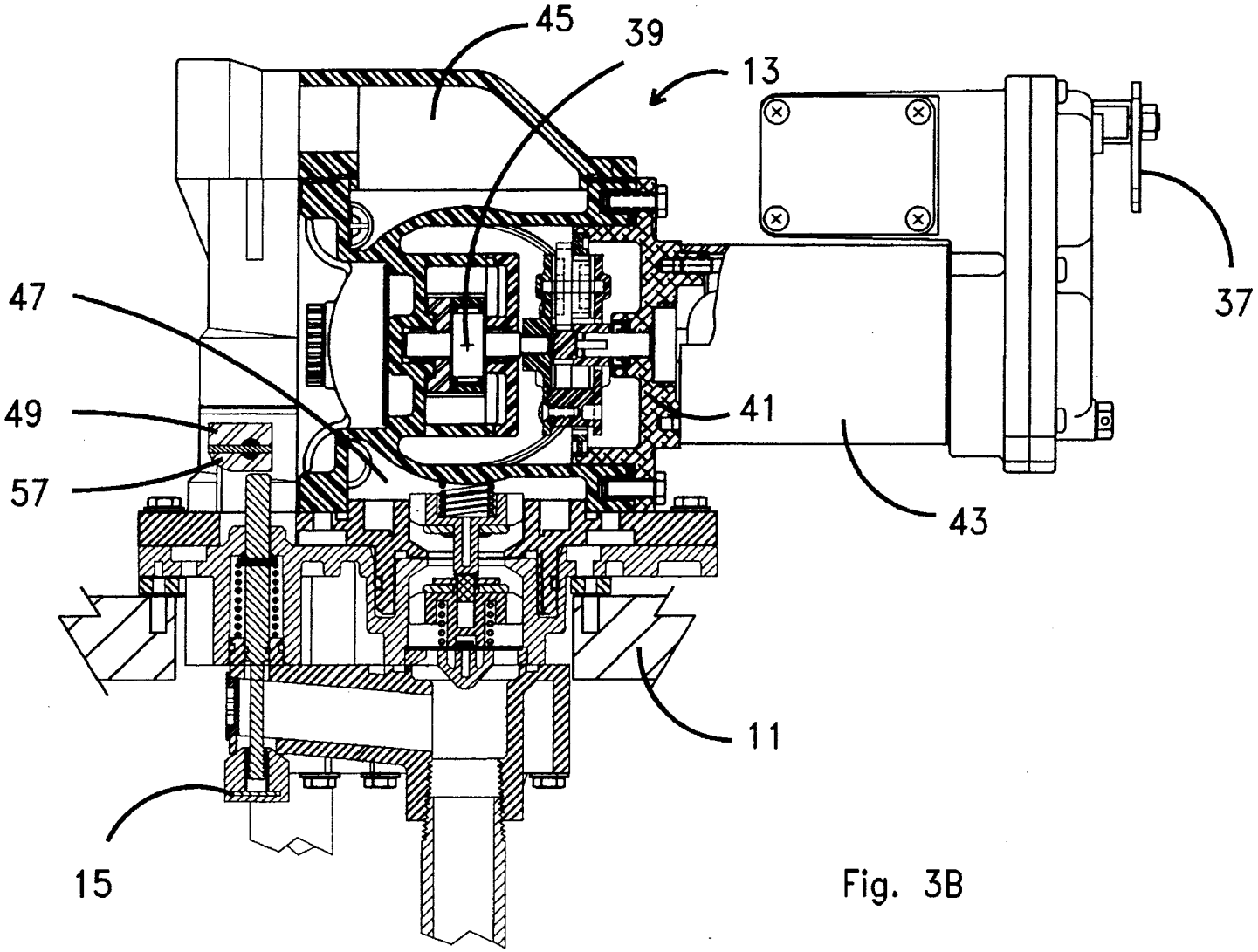
FIG. 3B is a detailed cross-sectional view along the lines 2—2 of FIG. 3D.
Figure 3C:
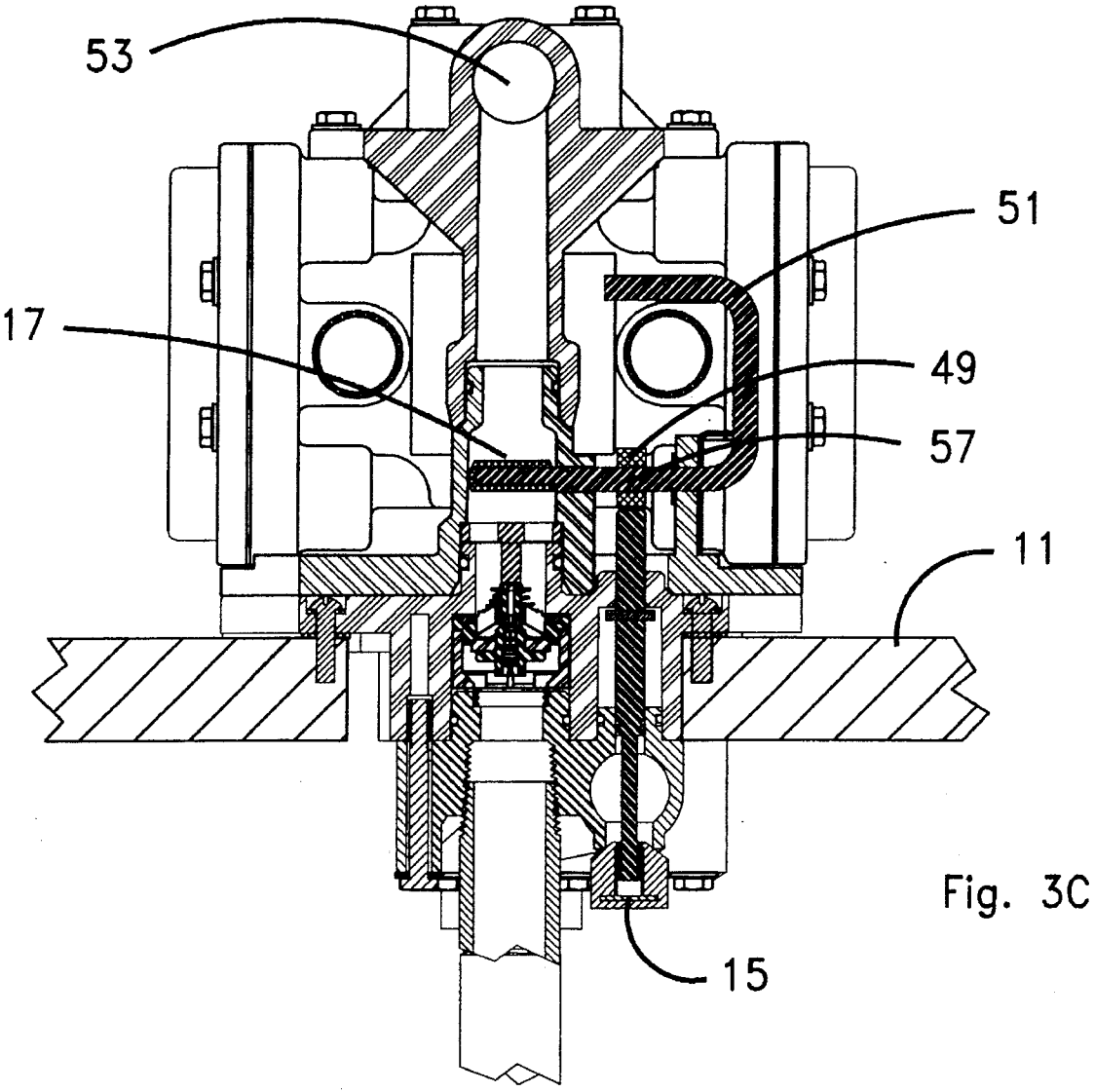
FIG. 3C is a detailed cross-sectional view along the lines 3—3 of FIG. 3D.
Figure 3D:
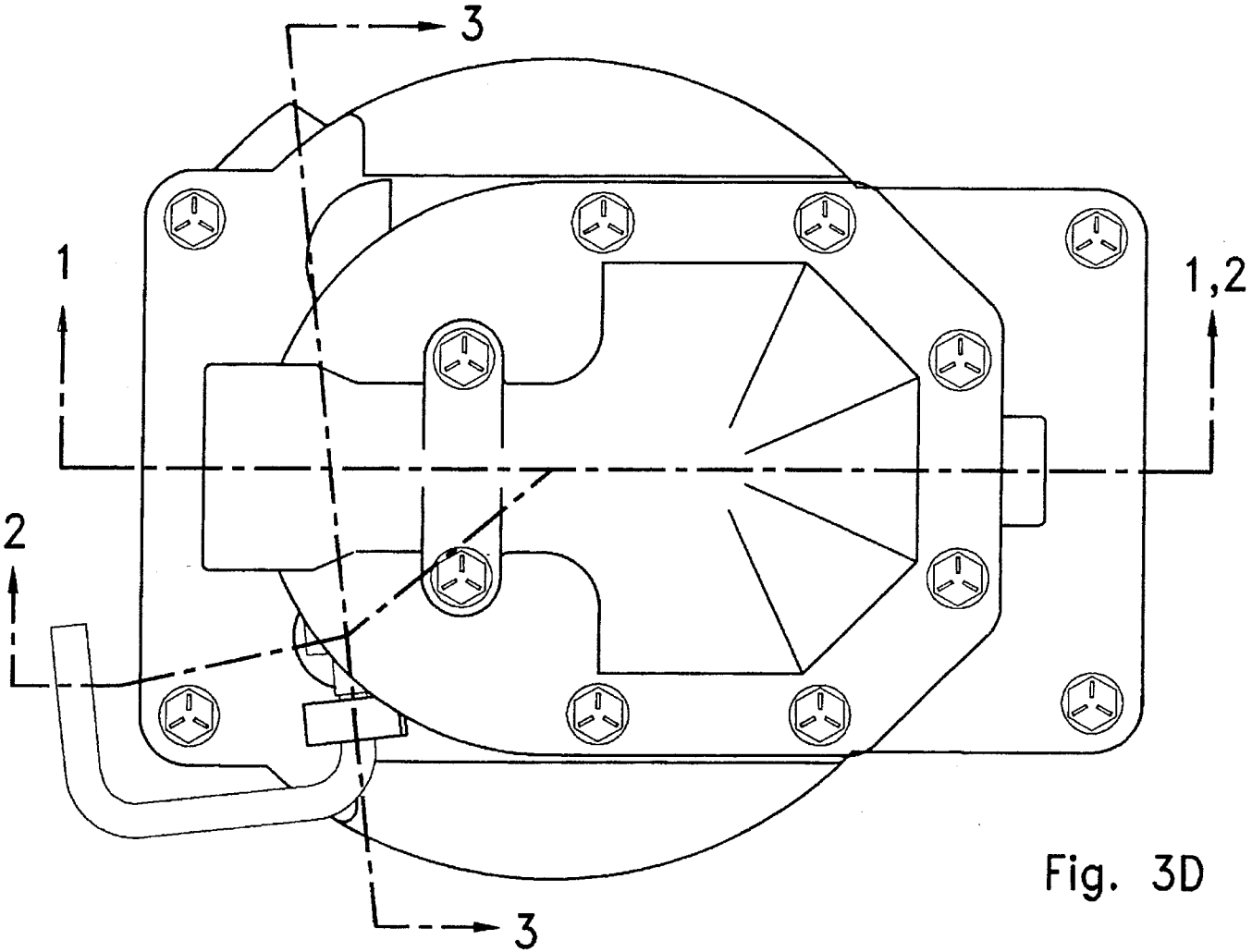
FIG. 3D is a plan view of the sparging adapter.

FIG. 1 shows liquid being pumped by liquid pump 13 from the tank 11 toward a conventional dispenser nozzle along the path indicated by the arrows 19, 21 and 23. There are two closed valves 15 and 17 which are movable together to open positions as shown in FIG. 2. When sparging is desired, the conventional dispensing nozzle is closed as indicated at 24 in FIG. 2 if it was not already closed, valve 15 is opened breaking prime so that the pump can no longer draw liquid up through pipe 25, but rather, ingests air from head space above the liquid in region 35. At the same time, valve 17 is opened providing an air path to the bottom of the tank through pipe 27. Air now circulates along the path shown by line 29, 31 and 33 in FIG. 2.

In FIG. 3, the double acting pump includes an electric motor 43 or other rotary drive device for powering the pump and its associated on/off switch 37. There is a shuttle block which is reciprocable along a path 39 perpendicular to the plane of the paper for actuating two pumping chambers. The motor 43 is coupled through a speed reduction gearbox 41 to a square drive shaft. The drive shaft passes through an eccentrically located square hole in a cam causing it to rotate about the off-center hole. The cam engages surfaces of the shuttle block thereby converting rotational motion of the drive motor into reciprocating motion of the shuttle block. There are a pair of pumping chambers including a pair of members such as diaphragms or pistons which move in unison in one direction to decrease the volume of one of the pumping chambers while increasing the volume of the other of the pumping chambers, and move in the opposite direction to decrease the volume of the other of the pumping chambers while increasing the volume of the one pumping chamber. Appropriate valving couples the pumping chambers to a common pump outlet manifold 45 for merging the fluids emanating from the chamber outlet check valves and a common pump suction inlet manifold 47 for supplying the fluid to the chamber inlet valves. The pump is described in greater detail in the abovementioned U.S. Pat. No. 5,219,274 patent. The pressure outlet manifold is normally coupled to a dispensing nozzle by way of conduit 53, but may also be coupled by way of conduit 55 to the tube 27 when valve 17 opens.

The two valves 15 and 17 are linked together for simultaneous actuation by a single lever 51 and cam 49.

The method of operation of the invention should now be clear. Air is recurrently pumped from the air space 35 above the liquid to a location near the bottom of the vessel beneath the liquid level to agitate and mix the liquid and particulate matter, if present. Liquid is pumped from a location near the bottom of the vessel beneath the liquid level for dispensing and utilization of the liquid at a time when air is not being pumped from the air space. The air and liquid pumping are performed using the same pumping device. When it is desired to sparge the tank, lever 51 is rotated 90 degrees counterclockwise, braking prime by opening valve 15, and opening the valve 17 in the air path down into the vessel.

In summary, the invention has a number of advantages over known prior schemes. The same pumping device is utilized for both dispensing and air sparging. Since air is drawn directly from the head space and circulated back through the liquid, the system is closed and the likelihood of contamination is minimized. The simple removal of pin 57 prevents cam actuation from opening valve 15. This temporarily partially disables the common actuation of the two valves 15 and 17 whereby valve 17 may be actuated independently while valve 15 remains closed to change between a fluid dispensing mode and a liquid recirculating mode.

From the foregoing, it is now apparent that a novel arrangement has been disclosed meeting the objects and advantageous features set out hereinbefore as well as others. For example, timed automatic sparging may be implemented. This and numerous other modifications as to the precise shapes, configurations and details may be made by those having ordinary skill in the art without departing from the spirit of the invention or the scope thereof as set out by the claims which follow.

What is claimed is:

1. A liquid containing vessel having an air space above the liquid near the top of the vessel;

a fluid pump having a suction inlet and a pressure outlet, the pump being operable in a first mode to pump liquid and in a second mode to pump air;

a first conduit coupling the suction inlet and liquid near the bottom of the vessel;

a second conduit coupling the suction inlet and the air space above the liquid near the top of the vessel;

a third conduit coupling the pressure outlet to a dispensing device;

a fourth conduit coupling the pressure outlet to liquid near the bottom of the vessel; and valve means operable to block both the second and fourth conduits for operating the pump in the first mode, and to open the second and fourth conduits for operating the pump in the second mode.

2. The combination of claim 1 wherein the valve means comprises a valve in the second conduit, a valve in the fourth conduit, and means common to the two valves for contemporaneous actuating the two valves.

3. The combination of claim 1 wherein the valve means further includes means for temporarily partially disabling the means for actuating the two valves whereby the fourth valve may be actuated while the second valve remains closed.

4. The combination of claim 1 wherein the valve means comprises a valve in the second conduit, a valve in the fourth conduit, operator actuable means common to the two valves for contemporaneous opening and closing of the two valves to change between a fluid dispensing mode and an air recirculating mode, and means for partially disabling the operator actuable means so that only the valve in the fourth conduit is opened and closed by operator actuation to change between a fluid dispensing mode and a liquid recirculating mode.

5. The method of dispensing liquid which requires mixing from a liquid containing vessel having an air space above the liquid near the top of the vessel comprising the steps of;

recurrently pumping air from the air space above the liquid to a location near the bottom of the vessel beneath the liquid level to agitate and mix the liquid and any particulate matter which may be present; and pumping liquid from a location near the bottom of the vessel beneath the liquid level for dispensing and utilization of the liquid at a time when air is not being pumped from the air space.

6. The method of claim 5 wherein the steps of recurrently pumping air and pumping liquid are performed using the same pumping device.

7. The method of dispensing liquid from a liquid containing vessel comprising the steps of;

utilizing a pumping device to repeatedly pump air to a location near the bottom of the vessel beneath the liquid level to agitate and mix the liquid; and utilizing the same pumping device to pump liquid from a location near the bottom of the vessel beneath the liquid level for dispensing and utilization of the liquid at a time when air is not being pumped from the air space.

8. The method of claim 7 wherein the vessel has an air space above the liquid near the top of the vessel and the air which is repeatedly pumped to the location near the bottom of the vessel is obtained from the air space above the liquid.

* * * * *